US007297853B2

(12) United States Patent
Liao

(10) Patent No.: US 7,297,853 B2
(45) Date of Patent: Nov. 20, 2007

(54) ANGLE ADJUSTING CYMBAL BASE ASSEMBLY

(76) Inventor: Tsun-Chi Liao, 1F, No.7, Lane 545, Sec. 2, Jyungong Rd., Beitun District, Taichung City (TW)

( * ) Notice: Subject to any disclaimer, the term of this patent is extended or adjusted under 35 U.S.C. 154(b) by 221 days.

(21) Appl. No.: 11/144,822

(22) Filed: Jun. 6, 2005

(65) Prior Publication Data

US 2006/0272477 A1 Dec. 7, 2006

(51) Int. Cl.
*G10D 13/02* (2006.01)

(52) U.S. Cl. ..... 84/422.3; 84/422.1

(58) Field of Classification Search ..... 84/422.3, 84/422.1, 422.2, 421
See application file for complete search history.

(56) References Cited

U.S. PATENT DOCUMENTS 6,570,075 B1 * 5/2003 Lombardi ..... 84/421

7,102,066 B2 * 9/2006 Chang ..... 84/422.1

* cited by examiner

*Primary Examiner*—Lincoln Donovan
*Assistant Examiner*—Jianchun Qin
(74) *Attorney, Agent, or Firm*—Birch, Stewart, Kolasch & Birch, LLP

(57) ABSTRACT

An angle adjusting cymbal base assembly includes a base body provided with two sliding grooves. A sliding element is put in two sliding grooves and provided with a wedge-shaped pushing portion located at a side thereof. The sliding element is provided with a stopper located at the other side thereof. An adjusting screw bolt is locked to the base body and pushes the other side of the sliding element. The sliding element can be pushed by turning the adjusting screw bolt. The base body is provided with a central pillar connected to a passive element. The passive element is provided with an inclined portion pushed by the pushing portion, is at predetermined degree of inclination, and is pivotally connected to the base body, whereby a lower cymbal is stably supported, the inclined direction does not be change if the lower cymbal is struck, and the inclined direction is easily adjusted.

3 Claims, 6 Drawing Sheets

ANGLE ADJUSTING CYMBAL BASE ASSEMBLY

FIELD OF THE INVENTION

The present invention relates to an angle adjusting cymbal base assembly, and more particularly to an angle adjusting cymbal base assembly capable of adjusting the degree of inclination of a lower cymbal, whereby the lower cymbal is inclined, the lower cymbal is much stably supported, the inclined direction does not be change even if the lower cymbal is struck, the inclined direction is easily adjusted, and the appearance is beautiful.

BACKGROUND OF THE INVENTION

Conventional cymbal base assembly is shown in FIG. 1 PRIOR ART and FIG. 2 PRIOR ART, and includes a conical base body 1. The base body 1 is provided with a protrudent edge 2 disposed at the bottom thereof. The protrudent edge 2 is put around and connected to the top of a hollow main rod of a cymbal stand (not shown). The base body 1 is provided with a tubal rod 3 disposed at the central top thereof. A metal covering plate 4 is put around and connected to the tubal rod 3 for sealing the top of the base body 1. Also, a damping gasket 5 is put around the tubal rod 3 and connected to the metal covering plate 4. A lower cymbal 6 is straddled on and connected to the damping gasket 5. A screw bolt 7 is fastened upward in a side of the base body 1, and an end of the screw bolt 7 pushes a side of the bottom surface of the covering plate 4, whereby the covering plate 4 is at an angle, and the lower cymbal 6 which is straddled above the covering plate 4 is also straddled above the base body 1 at an angle. When an upper cymbal strikes the lower cymbal 6, they can generate clearly sweet sound effect.

The bottom of the covering plate 4 is inclined because the screw bolt 7 pushes the bottom of the covering plate 4 upward. However, the side of the bottom of the covering plate 4 only pushed at a point by the screw bolt 7. When the upper cymbal strikes the lower cymbal 6, it is easy that the vibration changes the direction of the lower cymbal 6. Thus, conventional cymbal base assembly is unstable, and the supporting force of the screw bolt 7 is not enough.

Accordingly, there exists a need for a cymbal base assembly to solve the above-mentioned disadvantages.

SUMMARY OF THE INVENTION

It is an object of the present invention provides an angle adjusting cymbal base assembly to solve the above-mentioned disadvantages.

In order to achieve the foregoing objects, the present invention provides an angle adjusting cymbal base assembly including a base body provided with two sliding grooves. A sliding element is put in two sliding grooves and provided with a wedge-shaped pushing portion located at a side thereof. The sliding element is provided with a stopper located at the other side thereof and being vertical upward. An adjusting screw bolt is locked to the base body and pushes the other side of the sliding element. The sliding element can be pushed by turning the adjusting screw bolt. The base body is provided with a central pillar connected to a passive element. The passive element is provided with an inclined portion pushed by a pushing portion of the sliding element, is at predetermined degree of inclination, and is pivotally connected to the side of the base body, whereby a lower cymbal is inclined, the lower cymbal is much stably supported, the inclined direction does not be change even if the lower cymbal is struck, the inclined direction is easily adjusted, and the appearance is beautiful.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DESCRIPTION OF THE PREFERRED EMBODIMENTS

Figure 1:
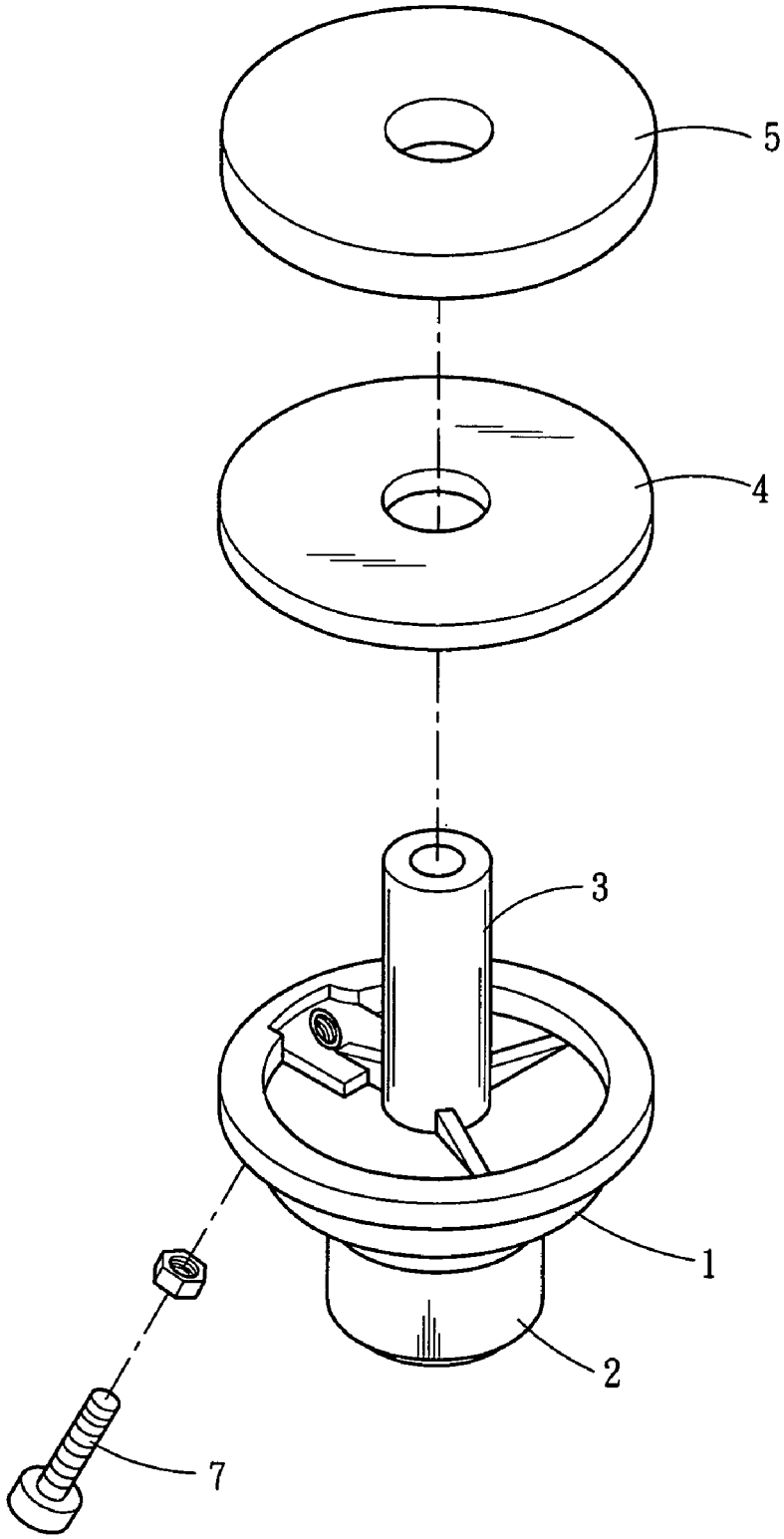
Fig . 1 PRIOR ART
FIG. 1 PRIOR ART is an exploded perspective view of a conventional cymbal base assembly.
Figure 2:
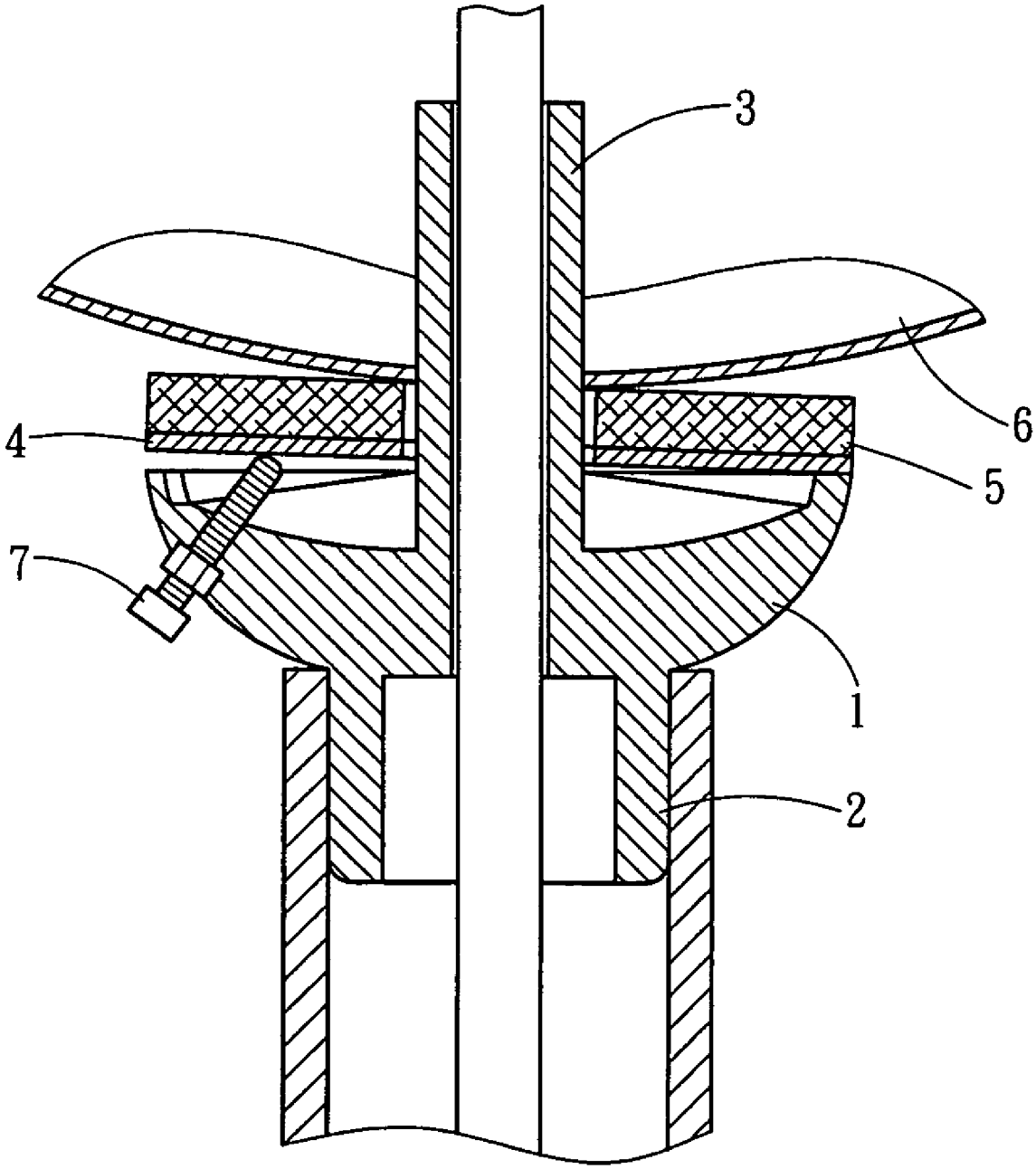
Fig. 2 PRIOR ART
FIG. 2 PRIOR ART is a cross sectional view showing the combination of a conventional cymbal base assembly.
Figure 3:
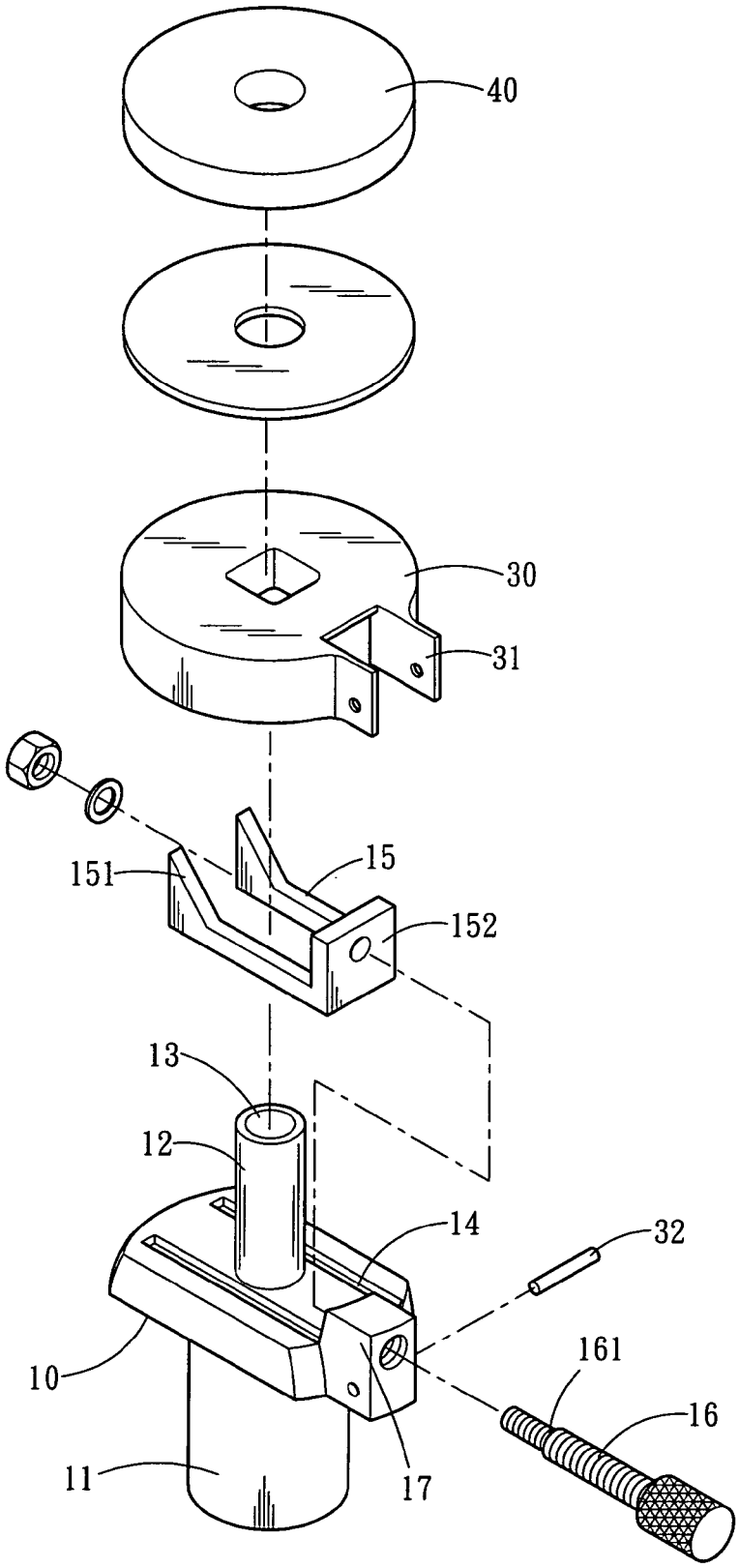
FIG. 3 is an exploded perspective view of an angle adjusting cymbal base assembly according to the first embodiment of the present invention.

Referring to FIG. 3, it depicts an angle adjusting cymbal base assembly of the prevent invention. The cymbal base assembly includes a metal base body 10.

Figure 4A:
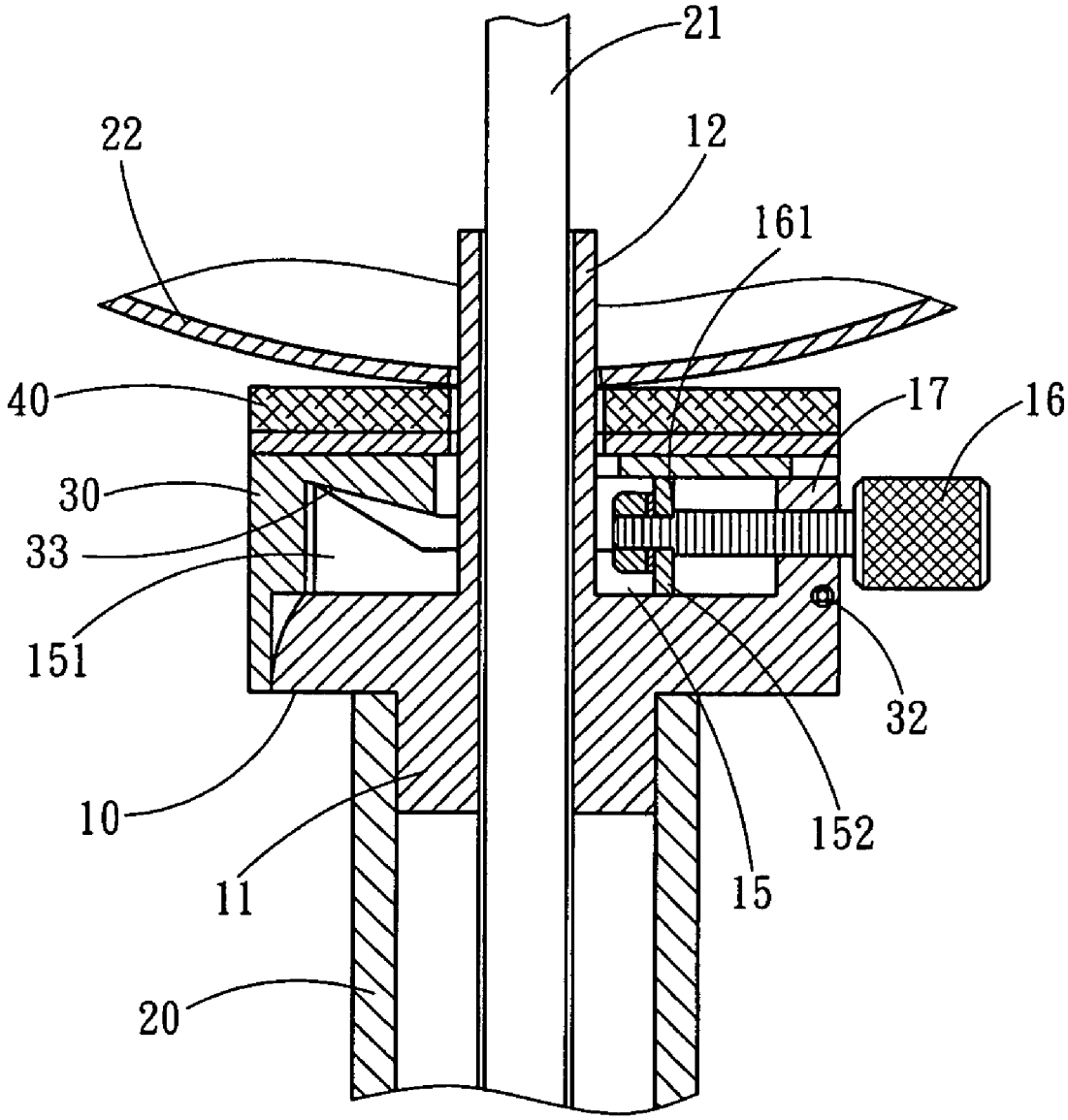
FIG. 4A is a cross sectional view showing the combination of an angle adjusting cymbal base assembly according to the first embodiment of the present invention.
Figure 5:
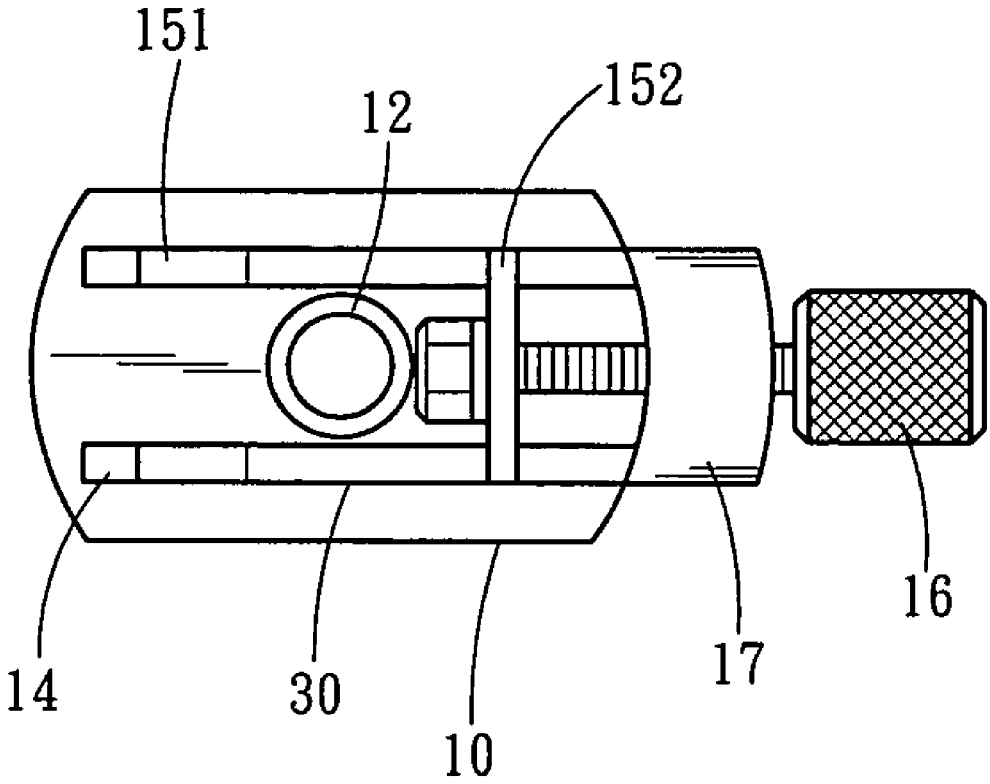
FIG. 5 is a top plan view of an angle adjusting cymbal base assembly according to the first embodiment of the present invention.

The base body 10 is provided with a protrudent tubal pillar 11 disposed at the bottom thereof. The tubal pillar 11 is put around and connected to the top of a hollow vertical rod 20 (shown in FIG. 4A) of a cymbal stand (not shown). The base body 10 is provided with a central pillar 12 disposed at the top thereof. The base body 10 is provided with a through circular tube 13 located at the center thereof: The circular tube 13 is adapted for providing a pulling rod 21 to pass through the circular tube 13, wherein the pulling rod 21 is disposed at the center of the cymbal stand. The top of the pulling rod 21 can be connected to an upper cymbal (not shown). When the pulling rod 21 is pulled downward, the upper cymbal is driven to strike a lower cymbal 22. Also, the base body 10 is provided with two sliding grooves 14 disposed in the top surface thereof, and the base body 10 is provided with a pivoting portion 17 expanding from a side of the sliding groove 14. The bottom of a U-shaped sliding element 15 can be put in two sliding grooves 14, and the hollow portion of the sliding element 15 clips two sides of the central pillar 12. Also, the sliding element 15 is provided with a pair of wedge-shaped pushing portion 151 located at a side thereof, wherein the inner surface of the pushing portion 151 is inclined downward. The sliding element 15 is provided with a stopper 152 located at the other side thereof, wherein the stopper 152 is vertical upward. The stopper 152 is provided with a through hole, the rear end of an adjusting screw bolt 16 passes through the through hole, and the rear end of the adjusting screw bolt 16 is locked by a screw nut. The outer diameter of the rear end of the adjusting screw bolt 16 is less than that of the main body of the adjusting screw bolt 16 so as to form a shoulder 161. The shoulder 161 pushes the outer wall of the stopper 152 of the sliding element 15. The adjusting screw bolt 16 is locked to a screw hole of the pivoting portion 17 of the base body 10, and is parallel with the sliding grooves 14 of the base body 10, shown in FIG. 5.

Figure 4B:
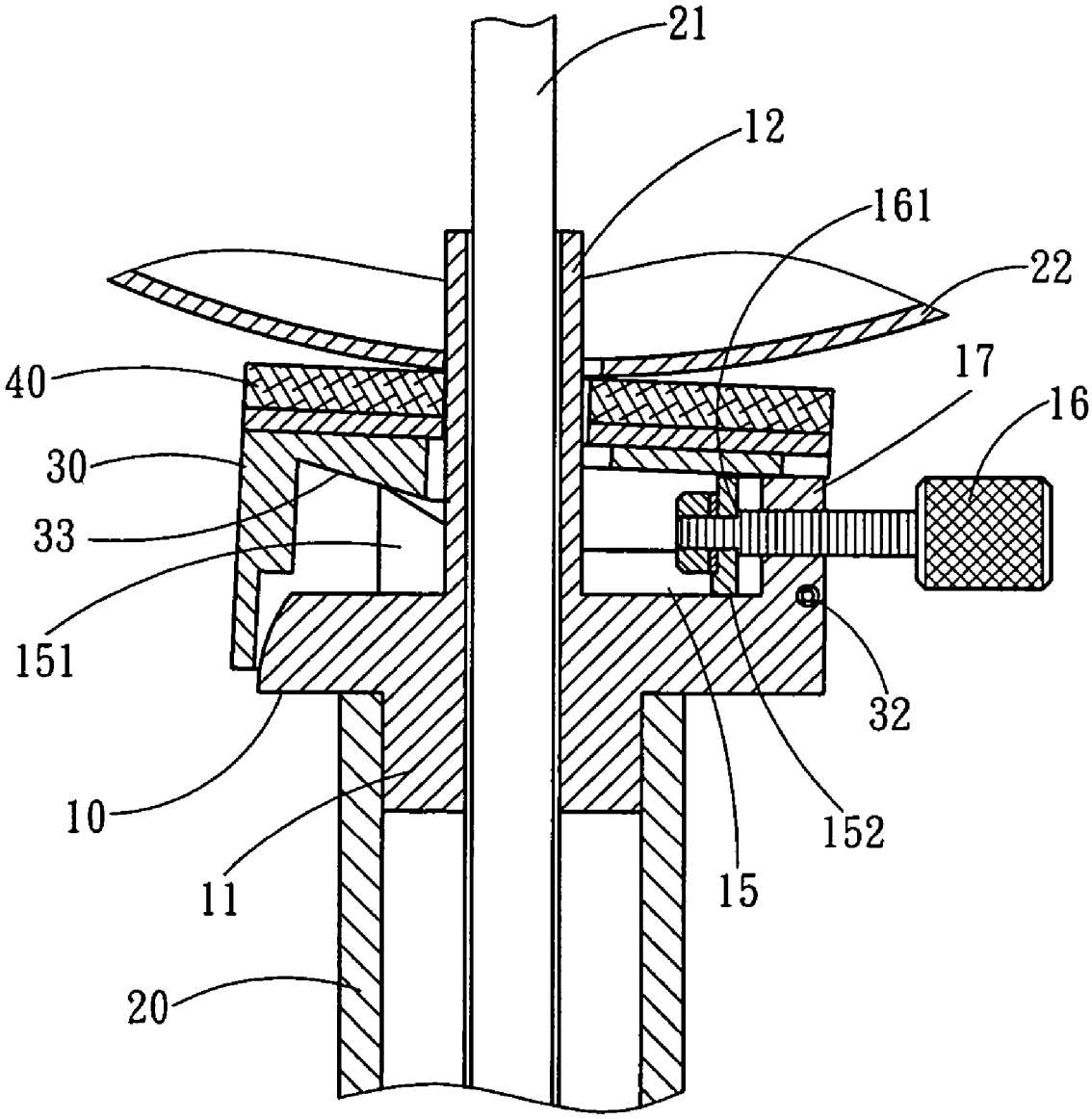
FIG. 4B is a cross sectional view showing the motion of the angle adjusting cymbal base assembly shown in FIG. 4A.

A passive element 30 is similar to a hollow and circular housing for covering and sealing the base body 10. The passive element 30 is provided with an ear portion 31 located at a side thereof. A bolt 32 is passed through the ear portion 31, whereby the passive element 30 is pivotally connected to the pivoting portion 17 of the base body 10 transversely. Also, the passive element 30 is provided with an inclined portion 33 located inside the top wall thereof. The inclined portion 33 cooperates with the pushing portion 151 of the sliding element 15, whereby the inclined portion 33 is pushed by the pushing portion 151 of the wedge-shaped sliding element 15, shown FIGS. 4A and 4B. The top surface of the passive element 30 is inclined, and further the lower cymbal 22 which is straddled above the top surface of the passive element 30 is inclined. Also, a damping pad 40 is disposed between the passive element 30 and the lower cymbal 22 for stopping the vibration transmitted from the lower cymbal 22. More important, the passive element 30 which is located under the bottom of the lower cymbal 22 can be supported by the pair of pushing portions 151 of the sliding element 15 parallel to each other, thereby preventing the lower cymbal 22 from the vibration and change of direction when the lower cymbal 22 is struck, and solving the problem of supporting force. Specially, the passive element 30 is driven by the adjusting screw bolt 16, and thus the passive element 30 is not shaken when the upper cymbal strikes the lower cymbal 22. The passive element 30 which is supported by the pushing portions 151 of the sliding element 15 is kept at the predetermined degree of inclination. In other words, the lower cymbal 22 which is straddled above the passive element 30 can be adjusted at the predetermined degree of inclination, and the lower cymbal 22 is pushed by the pushing portion 151 of the sliding element 15, thereby preventing the lower cymbal 22 from the vibration and change of inclined direction.

It is noted that the passive element 30 of the prevent invention is a smooth circular housing for completely accommodating the base body 10 into an inner space thereof, and thus the appearance of the passive element 30 is simple and beautiful. Even if the degree of inclination of the passive element 30 is requested to change, the sliding element 15 disposed in the base body 10 can be pushed and moved by directly turning the adjusting screw bolt 16, i.e. the supporting position of inclined surface of the pushing portions 151 depends on the degree of inclination of the passive element 30. The operation is very convenient and quick.

Although the invention has been explained in relation to its preferred embodiment, it is not used to restrain the invention. It is to be understood that many other possible modifications and variations can be made by those skilled in the art without departing from the spirit and scope of the invention as hereinafter claimed.

What is claimed is:

1. An angle adjusting cymbal base assembly comprising:

a base body having a bottom disposed at a top of a hollow vertical rod of a cymbal stand, wherein the base body is provided with two sliding grooves disposed in the top surface thereof;

a sliding element put in two sliding grooves, and provided with a wedge-shaped pushing portion located at a side thereof;

an adjusting screw bolt pushing the other side of the sliding element, and locked to a pivoting portion of the base body; and a passive element pivotally connected to the pivoting portion, covering and sealing the base body, and provided with an inclined portion located inside a top wail thereof, wherein the inclined portion is pushed by the pushing pardon of the sliding element, and the base body is provided with a central pillar disposed at the top thereof, whereby the passive element passes through the central pillar, wherein the sliding element is provided with a stopper located at the other side thereof and being vertical upward, the stopper is provided with a through hole, a rear end of the adjusting screw bolt passes through the through hole, the rear end of the adjusting screw bolt is locked by a screw nut, the outer diameter of the rear end of the adjusting screw bolt is less than that of a main body of the adjusting screw bolt so as to form a shoulder, and the shoulder pushes an outer wall of the stopper of the sliding element.

2. The angle adjusting cymbal base assembly according to claim 1, wherein the base body is provided with a through circular tube located at the center thereof, the circular tube is adapted for providing a pulling rod to pass through the circular tube, the pulling rod is disposed at the center of the cymbal stand, a top of the pulling rod is connected to an upper cymbal, the upper cymbal is driven to strike a lower cymbal when the pulling rod is pulled downward, and the angle adjusting cymbal base assembly further comprises a damping pad disposed between the passive element and the lower cymbal.

3. The angle adjusting cymbal base assembly according to claim 1, wherein the inner surface of the wedge-shaped pushing portion is inclined downward.

* * * * *